US009873013B2

(12) United States Patent
Williams

(10) Patent No.: US 9,873,013 B2
(45) Date of Patent: Jan. 23, 2018

(54) EXERCISE SYSTEM

(71) Applicant: Otis Williams, Garnerville, NY (US)

(72) Inventor: Otis Williams, Garnerville, NY (US)

( * ) Notice: Subject to any disclaimer, the term of this patent is extended or adjusted under 35 U.S.C. 154(b) by 0 days.

(21) Appl. No.: 14/800,104

(22) Filed: Jul. 15, 2015

(65) Prior Publication Data

US 2016/0082306 A1 Mar. 24, 2016

Related U.S. Application Data

(60) Provisional application No. 62/052,001, filed on Sep. 18, 2014.

(51) Int. Cl.

| | |
|---|---|
| ***A63B 21/02*** | (2006.01) |
| ***A63B 21/00*** | (2006.01) |
| ***A63B 21/002*** | (2006.01) |
| ***A63B 21/04*** | (2006.01) |
| ***A63B 21/055*** | (2006.01) |
| *A63B 71/02* | (2006.01) |

(Continued)

(52) U.S. Cl.

CPC ..... *A63B 21/4034* (2015.10); *A63B 21/0023* (2013.01); *A63B 21/00061* (2013.01); *A63B 21/00185* (2013.01); *A63B 21/0442* (2013.01); *A63B 21/0552* (2013.01); *A63B 21/0557* (2013.01); *A63B 21/4035* (2015.10); *A63B 23/03541* (2013.01); *A63B 23/03525* (2013.01); *A63B 23/03575* (2013.01); *A63B 23/1209* (2013.01); *A63B 23/1245* (2013.01); *A63B 2071/027* (2013.01); *A63B 2208/0238* (2013.01); *A63B 2209/02* (2013.01); *A63B 2225/093* (2013.01)

(58) Field of Classification Search

CPC ..... A63B 21/4035; A63B 21/0552; A63B 21/0442; A63B 21/0557; A63B 2210/50; A63B 23/03541; A63B 21/00065; A63B 23/03525; A63B 21/00069; A63B 23/03508; A63B 23/0355; A63B 23/12; A63B 21/00043; A63B 21/4033; A63B 21/15; A63B 21/16; A63B 21/4015; A63B 2208/0204; A63B 21/055; A63B 21/151; A63B 21/00061; A63B 2023/006; A63B 21/0555; A63B 21/02; A63B 21/4034

USPC ..... 482/121–126, 139

See application file for complete search history.

(56) References Cited

U.S. PATENT DOCUMENTS 3,369,809 A 2/1968 Morrill, Jr.
5,984,845 A 11/1999 Powers (Continued)

*Primary Examiner* — Andrew S Lo

(74) *Attorney, Agent, or Firm* — Global Intellectual Property Agency, LLC; Jordan Sworen

(57) ABSTRACT

An exercise system and method for performing various exercises, including a seated abdominal exercise. The exercise system includes an elongated, rigid bar having a first end and a second end, wherein a first and second ring fastener are disposed on each end and a third ring fastener is disposed therebetween. Various exercise attachments are removably securable to each ring fastener, such as elongated straps, a pull bar, resistance bands, and the like. The exercise system allows a user to manipulate the exercise attachment in a particular direction while applying opposing force to the elongated bar using his or her feet pressed thereagainst in order to build muscle, stretch, perform isometric exercises, physical therapy, and the like.

7 Claims, 5 Drawing Sheets

(51) Int. Cl.
*A63B 23/035* (2006.01)
*A63B 23/12* (2006.01)

(56) References Cited

U.S. PATENT DOCUMENTS 6,220,994 B1 * 4/2001 Rich ..... A63B 21/0004 482/123
6,558,301 B1 * 5/2003 Jackson ..... A63B 21/0552 482/121
7,322,909 B1 * 1/2008 Loccarini ..... A63B 17/00 482/126
7,942,793 B2 * 5/2011 Mills ..... A63B 21/00069 482/126
8,465,401 B1 * 6/2013 Ihli ..... A63B 21/00185 482/116
2005/0070406 A1 3/2005 Delp
2005/0113223 A1 * 5/2005 Dovner ..... A63B 21/0004 482/121
2005/0130814 A1 * 6/2005 Nitta ..... A63B 1/00 482/121
2006/0052223 A1 3/2006 Terry
2006/0128540 A1 * 6/2006 Engle ..... A63B 21/04 482/123
2006/0135329 A1 * 6/2006 Owen ..... A63B 21/04 482/123
2007/0087920 A1 * 4/2007 Dachraoui ..... A63B 21/0552 482/123
2007/0207905 A1 * 9/2007 Winston ..... A63B 5/20 482/126
2009/0111660 A1 * 4/2009 Snow ..... A63B 21/0552 482/38
2009/0137371 A1 * 5/2009 Fuller ..... A63B 21/0552 482/122
2010/0204023 A1 * 8/2010 Mills ..... A63B 21/00069 482/121
2010/0267529 A1 * 10/2010 Ayoub ..... A63B 23/1209 482/121
2011/0143896 A1 * 6/2011 Senegal ..... A63B 22/18 482/139
2011/0251033 A1 * 10/2011 Blancher ..... A63B 21/0442 482/123
2013/0277926 A1 10/2013 Rains
2013/0316882 A1 * 11/2013 Param ..... A63B 21/055 482/125
2014/0128230 A1 * 5/2014 Burcham ..... A63B 21/00185 482/123
2014/0155232 A1 * 6/2014 Wolan ..... A63B 21/0442 482/123

* cited by examiner

EXERCISE SYSTEM

CROSS REFERENCE TO RELATED APPLICATION

This application claims the benefit of U.S. Provisional Application No. 62/052,001 filed on Sep. 18, 2014. The above identified patent application is herein incorporated by reference in its entirety to provide continuity of disclosure.

BACKGROUND OF THE INVENTION

Field of the Invention

The present invention relates to exercise equipment. More specifically, the present invention provides an exercise system comprising an elongated bar having a plurality of ring fasteners disposed on an upper side thereof, wherein the ring fasteners are removably securable to various exercise attachments in order to perform various exercises thereon.

Exercise is an important daily routine that promotes healthy living. Many individuals enjoy the opportunity to complete different types of workouts utilizing one set of equipment. However, some workouts are not possible without certain types of equipment that are often only found in gyms. Unfortunately, paying a reoccurring monthly fee for membership to a gym is expensive.

Additionally, some people own vast amounts of exercise equipment for stretching, strength training, and performing physical therapy exercises. Such separate pieces of equipment are large and occupy an abundance of space in an individual's home. Therefore, there exists a need in the prior art for a system that can be utilized for performing a variety of exercises.

It is submitted that the present invention substantially diverges in design elements from the prior art and consequently it is clear that there is a need in the art for an improvement to existing exercise systems. In this regard the instant invention substantially fulfills these needs.

SUMMARY OF THE INVENTION

In view of the foregoing disadvantages inherent in the known types of exercise systems now present in the prior art, the present invention provides a new exercise system wherein the same can be utilized for providing convenience for the user when performing various exercises using an all-in-one exercise system.

It is therefore an object of the present invention to provide a new and improved exercise system that has all of the advantages of the prior art and none of the disadvantages.

It is another object of the present invention to provide an exercise system having an elongated, rigid bar adapted to interchangeably receive various exercise attachments that can be used to perform different exercises.

Another object of the present invention is to provide an exercise system comprising an elongated, rigid bar having a first end, a second end, and a front surface, wherein the front surface is adapted to receive a user's feet thereon.

Yet another object of the present invention is to provide an exercise system wherein elongated bar further comprises a plurality of ring fasteners secured to the front surface thereof and adapted to removably secure the interchangeable exercise attachments thereto, wherein a ring fastener is disposed on the first end of the bar, the second end, and therebetween.

Yet another object of the present invention is to provide an exercise system wherein the exercise attachments comprise a pair of elongated straps and a pair of handles adapted to allow a user to perform a seated abdominal exercise, wherein the handles are removably secured to the straps.

Another object of the present invention is to provide an exercise system that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 shows a perspective view of an embodiment of the exercise system.

FIG. 2. shows a perspective view of an embodiment of the exercise system in use.

DETAILED DESCRIPTION OF THE INVENTION

Figure 1:
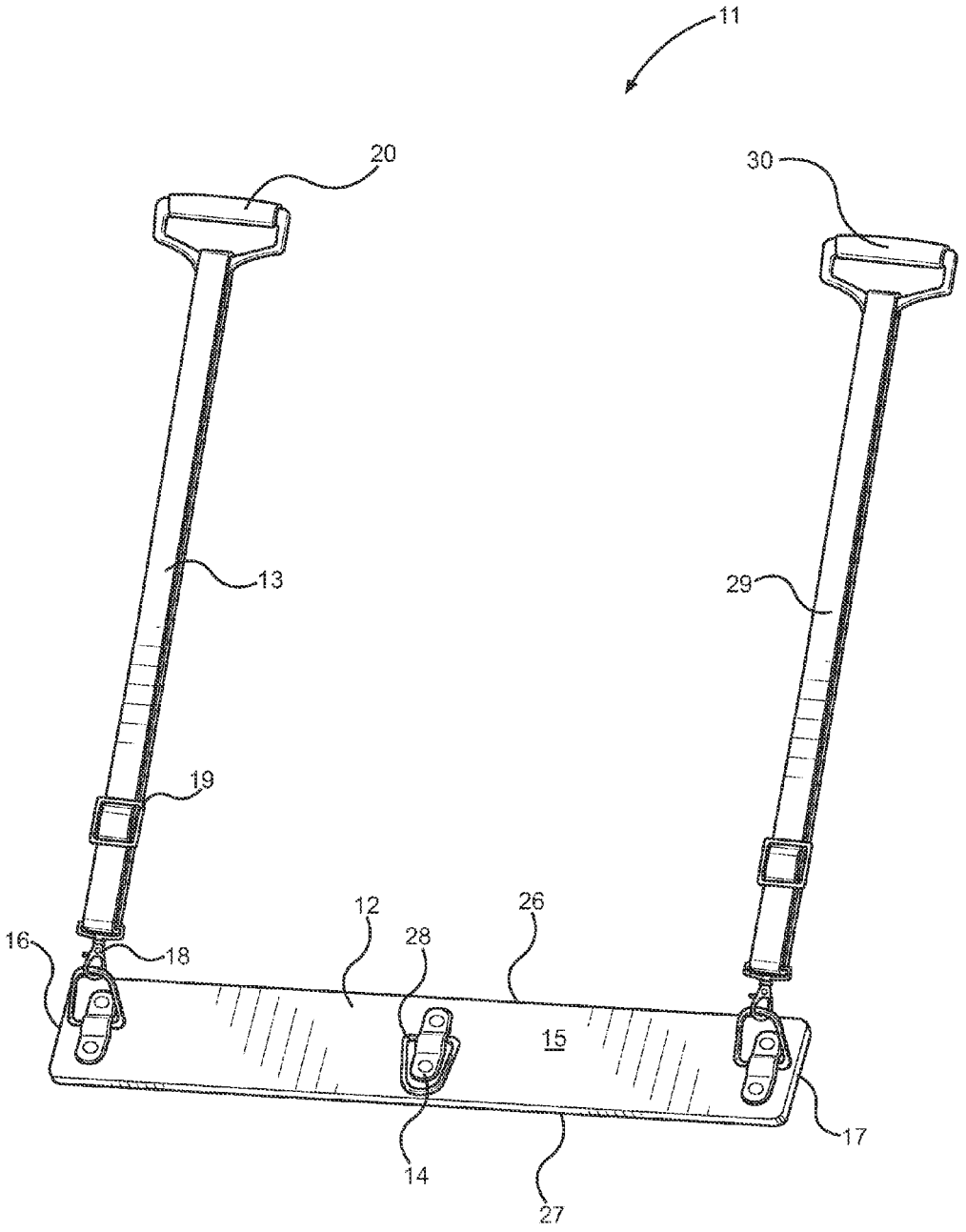

Reference is made herein to the attached drawings. Like reference numerals are used throughout the drawings to depict like or similar elements of the exercise system. For the purposes of presenting a brief and clear description of the present invention, the preferred embodiment will be discussed as used for performing various exercises, including a seated abdominal exercise. The figures are intended for representative purposes only and should not be considered to be limiting in any respect.

Referring now to FIG. 1, there is shown a perspective view of an embodiment of the exercise system. The exercise system 11 comprises an elongated, rigid bar 12 having a first end 16 and a second end 17. The elongated bar 12 is preferably rectangular in shape and is adapted to receive a user's feet on the front surface 15 thereof. In some embodiments, the front surface 15 comprises a non-slip layer so as to prevent a user's feet from sliding therealong when performing various exercises. The non-slip layer is preferably composed of rubber and, in other embodiments, comprises a texture thereon so as to allow a user's feet to frictionally remain on the elongated bar 12.

A plurality of ring fasteners 14 are disposed on the elongated bar 12. In the illustrated embodiment, a first ring fastener 14 is secured to the first end 16 of the bar 12, a second ring fastener 14 is secured to the second end 17 of the bar 12, and a third ring fastener 14 is disposed between the first end 16 and the second end 17. Each ring fastener 14 comprises a movable ring 28 pivotally secured to the front surface 15 of the elongated bar 12. The ring 28 is adapted to pivot between a first side 26 of the elongated bar 12 to a second side 27, wherein the ring 28 is able to rest flush against the bar 12. The pivoting of the ring 28 allows a user to have a 180 degree range of motion when performing exercises on the exercise system 11.

The exercise system 11 further comprises a plurality of exercise attachments 13 removably securable to the ring fasteners 14. The exercise attachments 13, in conjunction with the elongated bar 13, are adapted to allow a user to perform various strength exercises, stretching movements, isometrics, pilates, and physical therapy. In the illustrated embodiment, the exercise attachments 13 are a pair of elongated straps 29 having a first end and a second end, wherein each strap 29 comprises an adjustment mechanism 19, such as a buckle, adapted to allow the user to adjust the length of the strap 29 in order to accommodate his or her height.

The first end of the each elongated strap 29 is removably secured to the elongated bar 12 via a fastener 18 disposed on the first end of the strap 29. Any suitable fastener 18 is disposed on the first end of the strap 29, including a clip, wherein the fastener 18 is adapted to removably secure to a ring fastener 14 disposed on the elongated bar 12. The second end of the elongated strap 29 is secured to a handle, wherein the handle 20 comprises a horizontal member 30 adapted to receive a user's hand thereon in order to manipulate the straps 29. The elongated bar 12 allows a user to apply an opposing force using his or her feet placed on the front surface 15 thereof in order to generate a resistance against the pulling motion applied on the exercise attachments 13. The elongated straps 29 are composed of any suitable material, such as nylon.

Figure 2:
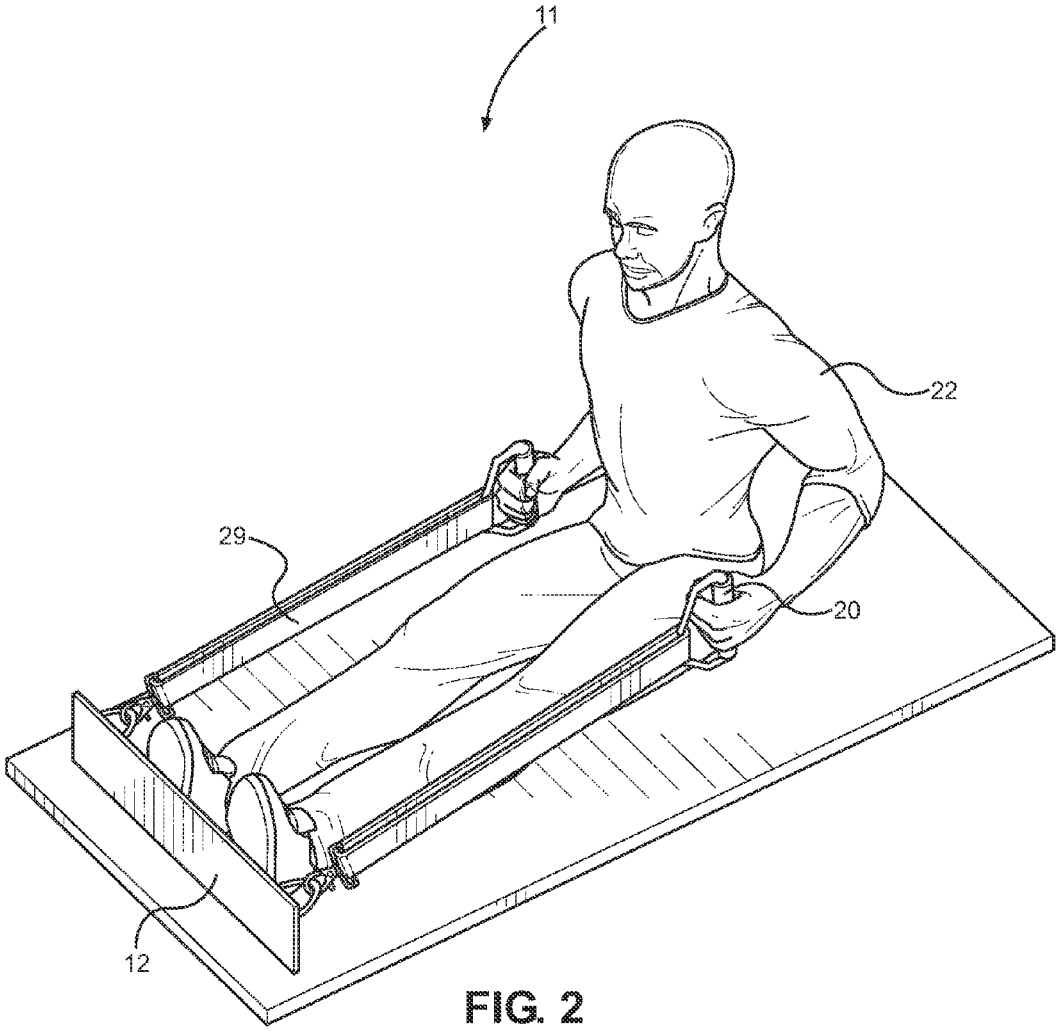

Referring now to FIG. 2, there is shown a perspective view of an embodiment of the exercise system in use. Using the elongated straps 29, the exercise system 11 is adapted to allow a user to perform a seated abdominal exercise. In operation, a user lies on his or her back with his or her legs bent. The elongated bar 12 is disposed vertically, wherein the user's feet are positioned on the front surface thereof. The user then grasps each handle 20 in each hand and pulls on the handles in order to sit up, wherein the back 22 of the user is disposed in a vertical position. The user then repeats the movement as many times as desired.

Figure 3:
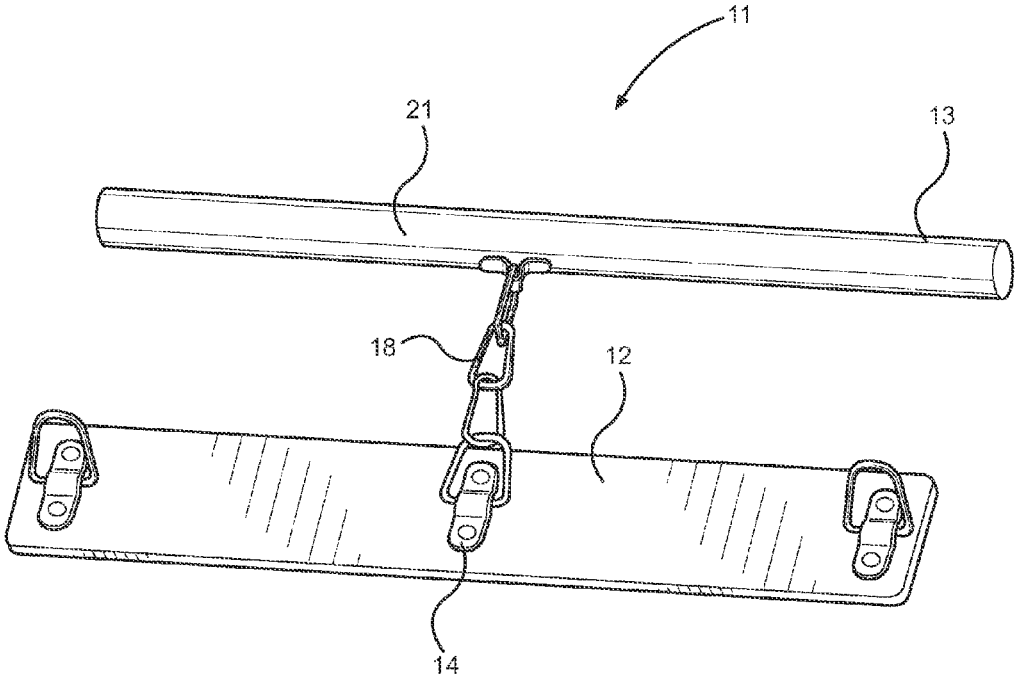
FIG. 3 shows a perspective view of an exercise attachment secured to the elongated bar of the exercise system.

Referring now to FIG. 3, there is shown a perspective view of an exercise attachment secured to the elongated bar of the exercise system. The elongated straps are adapted to be removed from the elongated bar 12 and interchanged with a different exercise attachment 13. A different exercise attachment 13 comprises a pull bar 21 that is removably secured to the third ring fastener 14 disposed on the elongated bar 12. The pull bar 21 comprises a rod having a first end, a second end, and a first side opposing a second side, wherein the pull bar 21 is adapted to allow a user to perform isometric exercises. In some embodiments, the sides of the pull bar 21 each comprise an angle, wherein the sides mirror one another. The first side and second side of the pull bar 21 are adapted to be gripped by the user.

In operation, a user grasps opposing sides of the pull bar 21 and pulls upwards on the pull bar 21 while applying an opposing force with one's feet disposed against the elongated bar 12. In some embodiments, the exercise system 11 comprises a chain removably secured between the elongated bar 12 and the pull bar 21. This allows the pull bar 21 to be disposed at various distances from the elongated bar 12 so as to enable a user to perform isometric exercises on various muscle groups, such as a static hold. The pull bar 21 further comprises a fastener 18 on the first end that removably secures to the ring fastener 14. The first end of the pull bar 21 is positioned between the first side and the second side thereof. In some embodiments, the first end of the pull bar 21 is positioned in the middle between the first side and the second side thereof. Any suitable fastener 18 is disposed on the first end thereof, including a clip.

Figure 4:
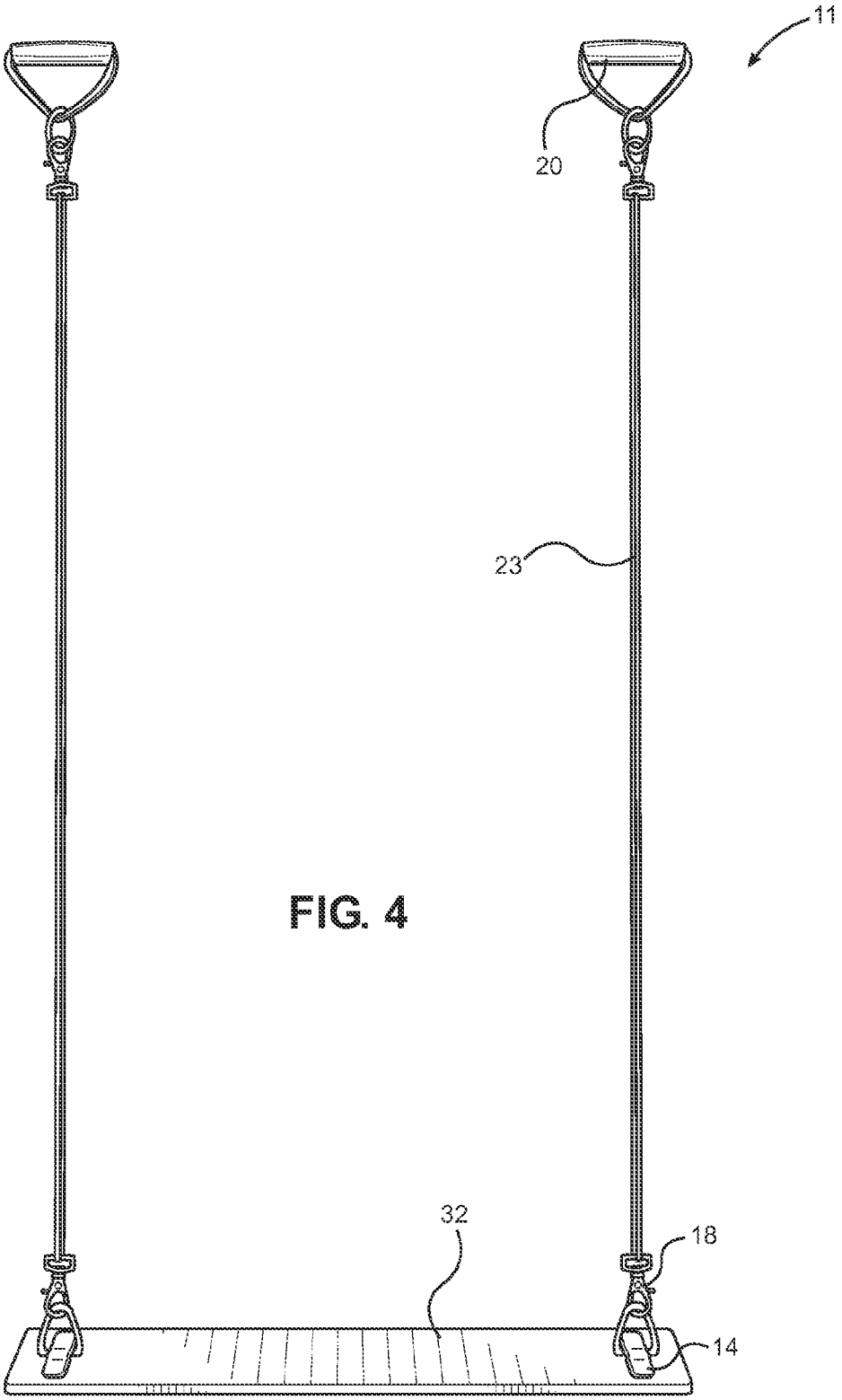
FIG. 4 shows a perspective view of an alternative embodiment of the elongated bar of the exercise system and an exercise attachment secured thereto.

Referring now to FIG. 4, there is shown a perspective view of an alternative embodiment of the elongated bar of the exercise system and an exercise attachment secured thereto. The exercise system 11 comprises one or more resistance bands 23 as an alternative exercise attachment, wherein the resistance bands 23 include a first end and a second end. In the illustrated alternative embodiment, the elongated bar 32 comprises a pair of ring fasteners 14 disposed on opposing ends thereof, wherein a center ring fastener 14 is not included. A pair of resistance bands 23 are disposed on the ring fasteners 14, wherein a second end of the resistance band 23 is removably secured to a handle 20 via a fastener disposed on the second end of the thereof. The resistance bands 23 comprise a flexible, elongated band that allows a user to perform resistance exercises, such as shoulder presses and bicep curls. The resistance band 23 further comprises a fastener 18 on the first end that removably secures to the ring fastener 14. Any suitable fastener 18 is disposed on the first and second end of the resistance band 23, including a clip. In other embodiment, the resistance bands 23 comprise varying levels of tension.

Figure 5:
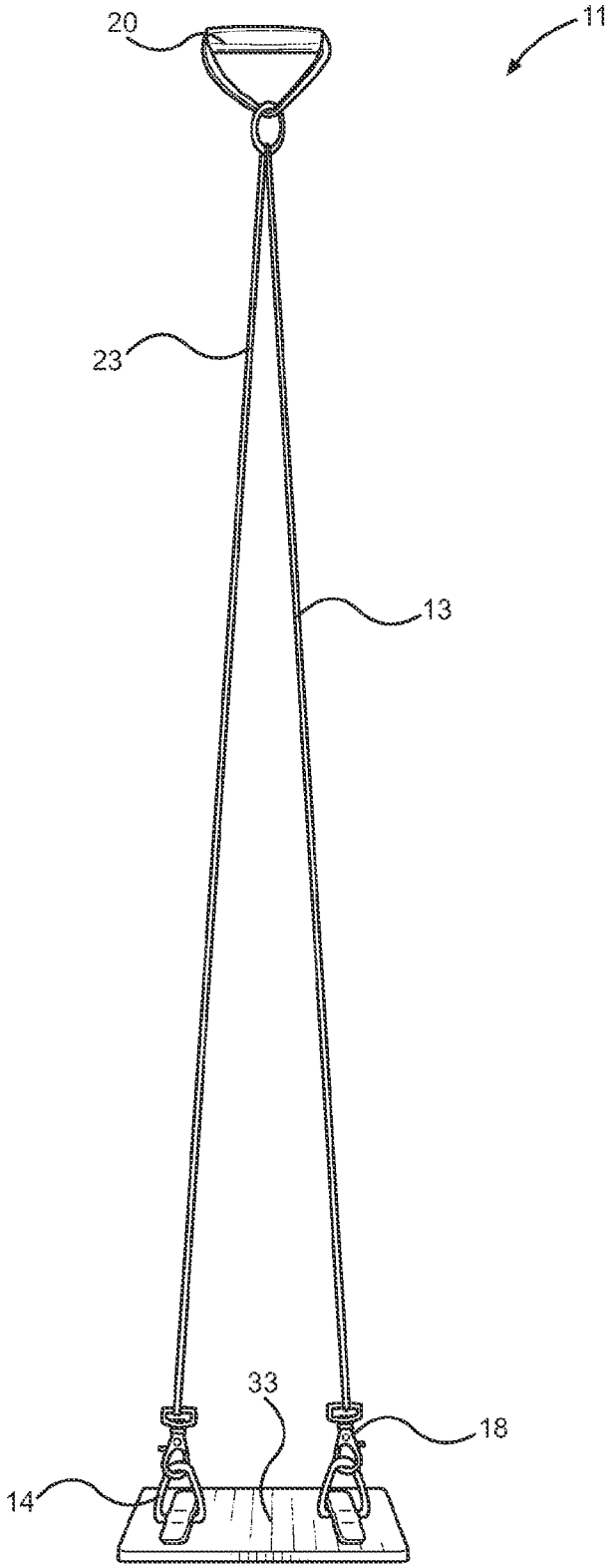
FIG. 5 shows a perspective view of an alternative embodiment of the elongated bar of the exercise system and an exercise attachment secured thereto.

Referring now to FIG. 5, there is shown a perspective view of an alternative embodiment of the elongated bar of the exercise system and an exercise attachment secured thereto. In an alternative embodiment, the elongated bar 33 is adapted to receive only one foot of a user thereon. The elongated bar 33 comprises a pair of ring fasteners 14 disposed on opposing ends thereof and one or more exercise attachments 13 removably secured thereto. In the illustrated embodiment, the elongated bar 33 comprises a single resistance band 23, wherein the first end and second end are each secured to a separate ring fastener 14 by a fastener 18 disposed on the ends thereof. Any suitable fastener 18 is disposed on the ends of the resistance band 23, including a clip. A handle 20 is removably secured to the center of the resistance band 23, wherein the handle 20 is adapted to be pulled in an upward direction and an opposing force is applied to the elongated bar 33 by the user. In this way, a user is able to concentrate on one side of the body or one muscle group when performing a particular exercise in order to enhance the muscle growth thereto.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise system, comprising:

an elongated bar having a first end, a second end, a front end, a rear end, and a front surface, wherein the first and second ends are shorter in length than the front and rear ends;

a first ring fastener disposed on said first end of said elongated bar and a second ring fastener disposed on said second end of said elongated bar;

a third ring fastener disposed between said first end and said second end of said elongated bar;

wherein the exercise system is void of any additional ring fasteners;

wherein the first, second, and third ring fasteners are arranged entirely linearly across the elongated bar;

wherein each of the first, second, and third ring fasteners comprise a pair of ends disposed flush against the front surface of the elongated bar and a channel extending therebetween and along a longitudinal axis of the elongated bar;

a first, second, and third movable ring positioned through the channel of the first, second, and third ring fasteners, respectively, wherein each of the first, second, and third movable rings are configured to only rotate 180 degrees around a same longitudinal axis of the elongated bar, the same longitudinal axis defined along the center between the front end and rear end of the elongated bar;

wherein each of the first, second, and third movable ring is perpendicular to the first end and second end of the elongated bar when positioned orthogonal to the front surface of the elongated bar;

one or more exercise attachments removably secured to the movable rings disposed on said front surface of said elongated bar, wherein said one or more exercise attachments each comprises a first end and a second end.

2. The exercise system of claim 1, wherein said one or more exercise attachments comprise a pair of elongated straps each having a first end and a second end, wherein said first end of each elongated strap is removably securable to said movable rings disposed on said elongated bar by a fastener disposed on each of said first end of said pair of elongated straps.

3. The exercise system of claim 2, further comprising one or more handles disposed on said second end of said pair of elongated straps.

4. The exercise system of claim 1, wherein said one or more exercise attachments comprise a pull bar having a first end, wherein said first end of said pull bar includes a fastener thereon adapted to be removably secured to said third movable ring.

5. The exercise system of claim 1, wherein said one or more exercise attachments comprise one or more resistance bands each having a first end and a second end, wherein said first end of each resistance band includes a fastener thereon adapted to be removably secured to said movable rings on said elongated bar, and said second end of each resistance band includes a fastener thereon adapted to be removably secured to a handle.

6. The exercise system of claim 1, wherein said second end of said one or more exercise attachments comprise a fastener that is removably securable to a handle.

7. The exercise system of claim 4, wherein the is a rigid clip that directly secures the pull bar to the third movable ring fastener.

* * * * *